US008649671B2

(12) United States Patent
Retiere et al.

(10) Patent No.: US 8,649,671 B2
(45) Date of Patent: Feb. 11, 2014

(54) ELECTRIC STORAGE WATER HEATER WITH DOUBLE CATHODIC PROTECTION

(75) Inventors: Bertrand Retiere, Dietwiller (FR); Cedric Geoffroy, Saint-Louis (FR)

(73) Assignee: S.A.T.E. Societe d'Applications Thermiques Europeenne, Fontaine (FR)

( * ) Notice: Subject to any disclaimer, the term of this patent is extended or adjusted under 35 U.S.C. 154(b) by 546 days.

(21) Appl. No.: 12/883,223

(22) Filed: Sep. 16, 2010

(65) Prior Publication Data

US 2011/0064392 A1 Mar. 17, 2011

(30) Foreign Application Priority Data

Sep. 16, 2009 (FR) ..... 09 56357

(51) Int. Cl.
*F22B 1/30* (2006.01)

(52) U.S. Cl.
USPC ..... 392/338

(58) Field of Classification Search
USPC ..... 392/338; 204/196.17, 196.24, 196.37, 204/196.38
See application file for complete search history.

(56) References Cited

U.S. PATENT DOCUMENTS

| | | | | |
|---|---|---|---|---|
| 3,135,677 | A * | 6/1964 | Fischer | 204/196.02 |
| 2007/0272544 | A1 * | 11/2007 | Bytyn | 204/196.11 |
| 2008/0230398 | A1 | 9/2008 | Glass et al. | |

FOREIGN PATENT DOCUMENTS

| | | | |
|---|---|---|---|
| CN | 2 623 700 | Y | 7/2004 |
| EP | 1 174 529 | A1 | 1/2002 |
| WO | 2007/010335 | A2 | 1/2007 |

OTHER PUBLICATIONS

French Search Report, dated Jun. 9, 2010, from corresponding French application.

* cited by examiner

*Primary Examiner* — Tu B Hoang
*Assistant Examiner* — Joseph Iskra
(74) *Attorney, Agent, or Firm* — Young & Thompson

(57) ABSTRACT

An electric storage water heater with double cathodic protection includes a sacrificial anode (5) and an impressed current anode (6) combined so as to provide cathodic protection, even in the absence of a power supply. The sacrificial anode (5) surrounds the impressed current anode (6) so as to prevent any contact of the impressed current anode (6) with the water of the water tank before consumption of the sacrificial anode (6).

7 Claims, 1 Drawing Sheet

ELECTRIC STORAGE WATER HEATER WITH DOUBLE CATHODIC PROTECTION

BACKGROUND OF THE INVENTION

The invention relates to an electric storage water heater with double cathodic protection.

Two types of cathodic protection are known for protecting an electric storage water heater against corrosion: either cathodic protection using a sacrificial anode such as a magnesium anode, or cathodic protection using an impressed current permanent anode.

The magnesium anode needs to be replaced periodically when it reaches the end of consumption, whilst the impressed current anode needs to be constantly fed by an electrical power source in order to provide cathodic protection.

DESCRIPTION OF THE PRIOR ART

Document WO 2007/010335 describes an electric storage water heater with adjustable cathodic protection. This electric storage water heater is protected against corrosion under normal operating and power supply conditions by an impressed current permanent electrode, whilst the water heater is protected in the absence of power by a sacrificial anode. The sacrificial anode is electrically connected to the tank of the water heater by a switch that is intended to break the electrical connection when the power supply feeds said impressed current permanent electrode. This device is generally satisfactory, but specifically requires the sacrificial anode to be disconnected when there is a power supply, to prevent the excessive consumption thereof.

SUMMARY OF THE INVENTION

A first objective of the invention is to improve the known prior art, by proposing a novel electric storage water heater with double cathodic protection, that does not require the sacrificial anode to be disconnected when there is a power supply, while preventing excessive consumption.

A second objective of the invention is to provide the cathodic protection of an electric storage water heater, even using an off-peak-hours power supply system that involves a lack of power for long durations of around 16 hours.

One subject of the invention is a storage water heater with double cathodic protection, comprising a sacrificial anode and an impressed current anode, wherein the sacrificial anode surrounds the impressed current anode and has a conformation suitable for avoiding any contact of the impressed current anode with the water of the tank of the electric water heater, before consumption of the sacrificial anode.

As claimed in other alternative features of the invention:

- the impressed current anode is in electrical contact with the sacrificial anode;
- the sacrificial anode comprises a recess for mounting the impressed current anode;
- the sacrificial anode is mounted on a support or a retaining sheath by means of an elastomeric sleeve;
- the impressed current anode is mounted on a support or a retaining sheath by means of an elastomeric sleeve;
- the elastomeric sleeve of the sacrificial anode surrounds the elastomeric sleeve of the impressed current anode;
- the dimensions of the sacrificial anode are significantly greater than the dimensions of the impressed current anode;
- the sacrificial anode and impressed current anode have substantially cylindrical conformations;

- the diameter of the sacrificial anode is substantially greater than the diameter of the impressed current anode; and
- the impressed current anode is made of titanium and the sacrificial anode is made of magnesium.

BRIEF DESCRIPTION OF THE DRAWINGS

The invention will be better understood by virtue of the description which will follow, given by way of non-limiting example with reference to the appended drawings in which:

With reference to FIGS. 1 to 4, identical or functionally equivalent elements are identified by identical reference numbers.

DESCRIPTION OF THE PREFERRED EMBODIMENT

Figure 1:
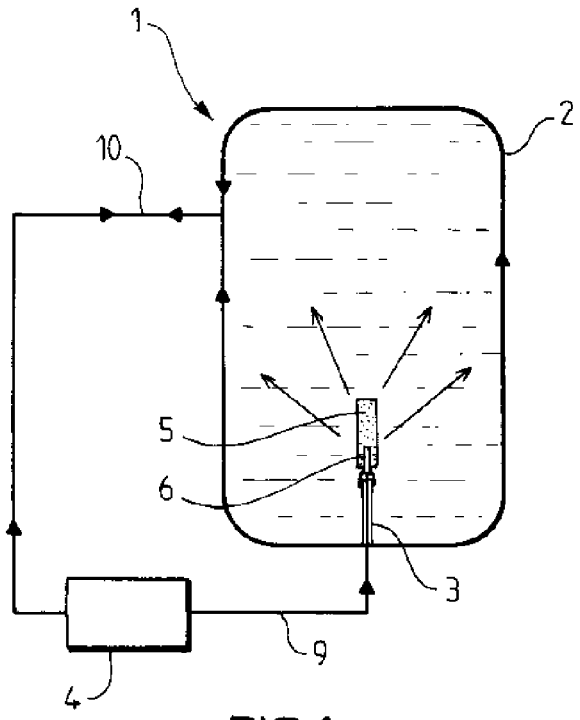
FIG. 1 schematically represents an electric storage water heater as claimed in the invention.

In FIG. 1, an electric storage water heater denoted in its entirety by (1) comprises a tank (2), a retaining sheath (3), a voltage generator (4), a sacrificial anode (5) and an impressed current anode (6).

The electric circuit of cathodic polarization comprises the sacrificial anode (5) in electrical contact with the impressed current anode (6) made, for example, of titanium.

The mounting of the magnesium sacrificial anode (5) and of the titanium impressed current anode (6) on the retaining sheath (3) is carried out by one of the insulating retaining means (7) and (8) which are described in detail with reference to FIG. 2.

An insulated conductor (9) for supplying power and an insulated conductor (10) for connecting to the tank (2) of the water heater (1) are provided in order to connect the protection current generator (4) to the electric storage water heater (1).

Figure 2:
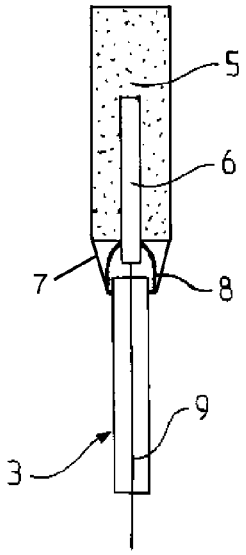
FIG. 2 schematically represents a partial enlarged view illustrating the device for cathodic protection of the electric storage water heater from FIG. 1.

In FIG. 2, the magnesium sacrificial anode (5) comprises a recess for mounting the titanium impressed current anode (6), so as to almost entirely embed the titanium anode (6) within the magnesium anode (5).

The titanium anode (6) is mounted on the retaining support (3) with the aid of an insulating and flexible sleeve, for example made of an elastomer, over the outer circumference of the retaining sheath (3).

The space inside the elastomeric sleeve (8) is connected to the atmosphere of the inside of the insulating support (3), without any contact with the water that fills the tank of the water heater.

The magnesium sacrificial anode (5) is mounted on the insulating support or retaining sheath (3) by means of an elastomeric insulating sleeve (7) positioned over the periphery of the insulating support (3).

In the case of a new sacrificial anode (5), the space between the elastomeric sleeves (7) and (8) is isolated from the water of the tank of the water heater due to the fact that the radially outer sleeve (7) completely surrounds the upper end of the retaining sheath (3) bearing the elastomeric sleeve (8).

The externally insulated electrical conductor (9) is connected to the titanium impressed current anode (6) so that the titanium impressed current anode (6) may be constantly powered during the electric power supply periods of the electric storage water heater.

Figure 3:
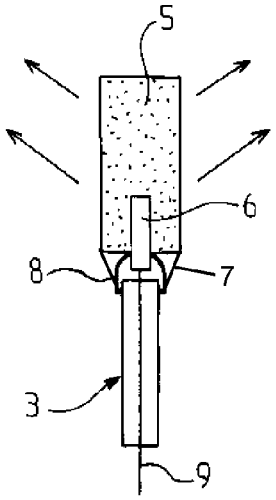
FIG. 3 schematically represents a partial view analogous to FIG. 2 illustrating the operation of the invention.

In FIG. 3, at the start of operation, the titanium impressed current anode (6) is not in contact with the water of the water heater, and the current which passes through this titanium impressed current anode can only be discharged through the magnesium sacrificial anode (5). Due to the fact that the diameter and the general dimensions of the magnesium sacrificial anode (5) are much greater than the diameter and the dimensions of the titanium impressed current anode (6), the current densities passing through the magnesium anode are much lower than those passing through the titanium anode.

However, the provision of the cathodic polarization current makes it possible to slightly increase the protective electrochemical current which is naturally established between the magnesium sacrificial anode (5) and the tank (2) of the electric storage water heater, thus reinforcing the effect thereof.

Thus, by virtue of the invention, the electric storage water heater is constantly protected, even in the case of an electric power supply that is interrupted over time, using only off-peak-hours power.

The operation of the electric water heater as claimed in the invention is thus practically identical to the operation of an electric water heater of the prior art protected solely by a magnesium sacrificial anode.

Figure 4:
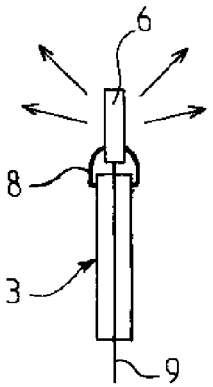
FIG. 4 schematically represents a partial view analogous to FIGS. 2 and 3 illustrating the operation of the invention after consumption of the sacrificial anode.

In FIG. 4, the magnesium sacrificial anode has been practically consumed. The space between the sleeves (7) and (8) is then at least partially filled by the water which is inside the tank of the water heater, and the titanium impressed current anode (6) is at least partially in contact with the water of the water heater.

In this case, the operation of the electric water heater as claimed in the invention is identical to the operation of an electric storage water heater of the prior art equipped with a titanium impressed current anode.

The invention described in reference to one particular embodiment is in no way limited thereto, and on the contrary covers any modification of form and any embodiment variant within the scope and spirit of the invention.

The invention claimed is:

1. A storage water heater with double cathodic protection, comprising:

a water tank (2);

a retaining sheath (3);

a protection current generator (4);

a titanium impressed current anode (6);

a magnesium sacrificial anode (5), wherein the sacrificial anode surrounds the impressed current anode, and the sacrificial anode has a conformation avoiding any contact of the impressed current anode with the water of the tank, before consumption of the sacrificial anode;

an insulating retaining sleeve (8) mounting the sacrificial anode (5) and the impressed current anode (6) on the retaining sheath (3);

an electric circuit of cathodic polarization comprising the sacrificial anode (5) in electrical contact with the impressed current anode (6); and conductors (9, 10) supplying power to the protection current generator (4) and connecting the protection current generator (4) to the tank (2) and to the impressed current anode (6) via the sheath (3), wherein the sacrificial anode remains electrically connected when the protection current generator (4) is electrically connected to the tank (2), and during operation, while the sacrificial anode (5) is present, the impressed current anode (6) is not in contact with the water of the tank (2), and current which passes through the impressed current anode (6) is only discharged through the sacrificial anode (5).

2. The storage water heater of claim 1, wherein, the insulating retaining sleeve (8) is elastomeric and positioned over an outer circumference of the retaining sheath (3), and a space inside the elastomeric sleeve (8) is connected to an atmosphere of an inside of the retaining sheath (3), without any contact with the water that fills the tank.

3. The storage water heater of claim 1, wherein, the insulating retaining sleeve (8) is positioned over an outer circumference of the retaining sheath (3), a space inside the elastomeric sleeve (8) is connected to an atmosphere of an inside of the retaining sheath (3), without any contact with the water that fills the tank.

4. The storage water heater of claim 1, wherein, the sacrificial anode (5) is mounted on the retaining sheath (3) with the sacrificial anode (5) electrically isolated from the water of the tank by the insulating retaining sleeve (8).

5. The storage water heater of claim 1, wherein, the sacrificial anode (5) is mounted on the retaining sheath (3) with the sacrificial anode (5) electrically isolated from the water of the tank.

6. The storage water heater of claim 5, wherein, the protection current generator (4), via one of the conductors (9), is electrically connected to the current anode (6) so that the impressed current anode (6) is constantly powered during electric power supply periods of the electric storage water heater.

7. The storage water heater of claim 1, wherein, the protection current generator (4), via one of the conductors (9), is electrically connected to the current anode (6) so that the impressed current anode (6) is constantly powered during electric power supply periods of the electric storage water heater.

* * * * *